US011067350B1

(12) United States Patent
Shepard, Jr. et al.

(10) Patent No.: US 11,067,350 B1
(45) Date of Patent: Jul. 20, 2021

(54) HANDGUN FRAME CONVERSION SYSTEM

(71) Applicant: Lone Wolf Distributors, Inc., Priest River, ID (US)

(72) Inventors: Daniel Shepard, Jr., Priest River, ID (US); Robert Hansel, Priest River, ID (US); Zachary Carlson, Priest River, ID (US); Daniel Shepard, III, Priest River, ID (US); Matthew Vernon, Priest River, ID (US)

(73) Assignee: Lone Wolf Distributors, Inc., Priest River, ID (US)

( * ) Notice: Subject to any disclaimer, the term of this patent is extended or adjusted under 35 U.S.C. 154(b) by 0 days.

(21) Appl. No.: 16/668,944

(22) Filed: Oct. 30, 2019

Related U.S. Application Data

(60) Provisional application No. 62/753,686, filed on Oct. 31, 2018.

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC .. F41A 3/66; F41A 11/00; F41A 11/02; F41C 3/00
USPC ..... 42/16, 71.02, 72, 75.01, 75.02, 75.03, 42/75.04, 69.03
See application file for complete search history.

(56) References Cited

U.S. PATENT DOCUMENTS

| | | | | |
|---|---|---|---|---|
| 6,401,379 | B1 * | 6/2002 | Moon | F41A 3/66 42/71.01 |
| D886,935 | S * | 6/2020 | Shepard, Jr. | D22/108 |
| 2017/0191769 | A1 * | 7/2017 | Martindill | F41A 3/86 |
| 2017/0191784 | A1 * | 7/2017 | Kroyer | F41A 5/02 |
| 2017/0321980 | A1 * | 11/2017 | Wolf | F41A 21/488 |

* cited by examiner

*Primary Examiner* — John Cooper
(74) *Attorney, Agent, or Firm* — Wells St. John P.S.

(57) ABSTRACT

This invention discloses embodiments which disclose a handgun frame conversion and adapter system which provides for the conversion of use of a handgun frame from use with a first slide to use with a second and dissimilar slide (such as allowing a Glock® Gen 1, Gen 2 or Gen 3 slide to be used on a Gen 4 or Gen 5 Glock® compatible frame). Aspects of this frame conversion system include a conversion adapter which is installable and removable from the frame portion of the handgun, thereby allowing any one of a number of handgun slides to be mounted or installed on one frame.

8 Claims, 23 Drawing Sheets

HANDGUN FRAME CONVERSION SYSTEM

CROSS REFERENCE TO RELATED APPLICATION

This application claims priority to U.S. Provisional Patent Application Ser. No. 62/753,686, filed Oct. 31, 2018.

TECHNICAL FIELD

This invention generally relates to a pistol or handgun frame conversion system that facilitates the use of a second handgun slide for which the handgun frame was not originally configured to receive. More particularly some embodiments of this frame adapter system include a conversion adapter which is installable into the front portion of the handgun frame, and in some embodiments, also removable. This invention thereby allows dissimilar handgun slides to be used on said handgun frame. Some of said dissimilar handgun slides may include a slide designed with a dual stage spring configuration wherein the frame originally designed for the dual stage spring can then be converted via embodiments of this invention to receive a single stage spring slide. One example is that this invention allows the modification of a Glock® Gen 4 or Gen 5 (which are dual stage spring slides) frame to operably accept Glock® Gen 1, Gen 2 or Gen 3 slides (which are single stage spring slides).

BACKGROUND OF THE INVENTION

Semi-automatic handguns have been known for many years and there are several manufacturers who have been making and selling said handguns. As these manufacturers such as Glock® introduce newer generations of popular handguns, the configurations of the various components such as the slides (or the frames) may change with each new generation. One such change may be the utilization of a dual stage spring action slide versus a single stage spring in the slide, which may necessitate changes in the frame to accommodate slides with the dual stage springs. The newer frames designed to accommodate dual stage spring slides do not provide a desirable fit if the user wants to combine a single action spring slide on the frame designed and configured for a dual stage spring slide.

There are however many handgun users/owners who maintain preferences in the configuration of the handgun and of the use of particular components (such as slides) to be used in combination with the main body portion or frame of the handgun.

Glock® handguns in particular have, over time, been manufactured in time or generational groupings. For example, the early Glock® handguns are referred to as a "Generation 1" or "Gen 1" Glock®, and so on up through what is now referred to as Glock® Gen 5. As new generations are released, the slides used on a Glock® Gen 3 do not necessarily fit on the OEM frame for other Glock® generations such as a Glock® Gen 4 or Gen 5 (which are dual stage spring slides). As one example, typical Glock® Generations 1, 2 & 3 slides (which are single stage spring slides) are configured differently than the Generations 4 & 5 slides, and do not therefore fit on Generations 4 & 5 frames in a desirable way.

Users develop preferences as to particular types, features and/or the functionality of a slide (including whether single stage springs or dual stage springs therein), and sometimes desire to mix and match and place a Gen 3 slide on a Gen 4 frame, which has heretofore not been a desirable combination due to multiple factors, including a gap between the slide and the frame.

The manufacturer of the Glock® handguns for example released a newer generation or "Gen 4" of its popular handguns as a change or improvement over its prior "Gen 3" version. There are certain aspects to the Gen 4 handgun frame (including the hand grip) which may motivate some users to want to use the Gen 4 or Gen 5 frame, but who may also still prefer the advantages or features of a Gen 1, Gen 2 or Gen 3 slide (which are single stage spring receivers).

Thus far, despite the recognized need or consumer desire to use a single stage spring slide on a frame designed for a dual stage spring slide, until this invention there has heretofore been no solution provided. In the Glock® example the Gen 4 and Gen 5 Glock® frames generally include a receiver or dust cover portion with an opening or aperture larger than that required for a Gen 3, Gen 2 or Gen 1 equivalent Glock® due to a wider diameter spring assembly in the Gen 4 Glock® slide assembly. In some embodiments of this invention the conversion adapter may also act as a dust cover.

It is therefore an object of embodiments of this invention to provide a frame conversion system which facilitates the use of any one of a plurality of different or dissimilar handgun slides on the same handgun frame (including where an aspect of the dissimilarity is one slide being a single stage spring action slide and the second slide being a dual (or higher) stage spring action. Some embodiments of this invention utilize a conversion adapter which is attachable and detachable to the handgun frame and which facilitates the use of that single frame with any one of a number of slides (including slides from prior and differently configured generations of Glock® slides).

It is a further object of embodiments of this invention to provide such a handgun frame adapter which provides the conversion adapter and transition of a handgun frame such that the frame accepts slides from other generations of the Glock® handguns. As one example, a conversion adapter which allows a Glock® Gen 4 or Gen 5 compatible frame to receive a Glock® Gen 1, Gen 2 or Gen 3 slide.

An advantage of some embodiments of this invention for example is that the handgun frame adapter system described herein provides an adapter and transition to allow the use of a Glock® Gen 3 slide or receiver on a Glock® Gen 4 frame, including on a Glock® Gen 4 frame that the applicable Glock® Gen 3 was not originally sized to fit.

While the invention was motivated in addressing some objectives, it is in no way so limited. The invention is only limited by the accompanying claims as literally worded, without interpretative or other limiting reference to the specification, and in accordance with the doctrine of equivalents. Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 2 is a side perspective elevation view of an example of one embodiment of a conversion adapter which may be utilized in embodiments of this frame adapter system invention;

FIG. 9 is a front elevation perspective view of the front of the slide (including the barrel), the front portion of the frame, and showing the gap or aperture of the combination without the conversion adapter there-between;

FIG. 10 is a front elevation perspective cutaway view of the front of the slide (including the barrel), the front portion of the frame, and showing the gap or aperture of the combination without the conversion adapter there-between;

FIG. 11 is a front elevation view of the front of the slide (including the barrel), the front portion of the frame, and showing the combination without the conversion adapter and with a gap there-between;

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an" and "the" as used in the claims herein are used in conformance with long-standing claim drafting practice and not in a limiting way. Unless specifically set forth herein, the terms "a", "an" and "the" are not limited to one of such elements, but instead mean "at least one". It should be noted that Glock® is a trademark owned by Glock®, Inc., Smyrna, Ga., and there is no affiliation of any kind between the inventions, inventors or products described herein with Glock®, Inc.

Figure 1:
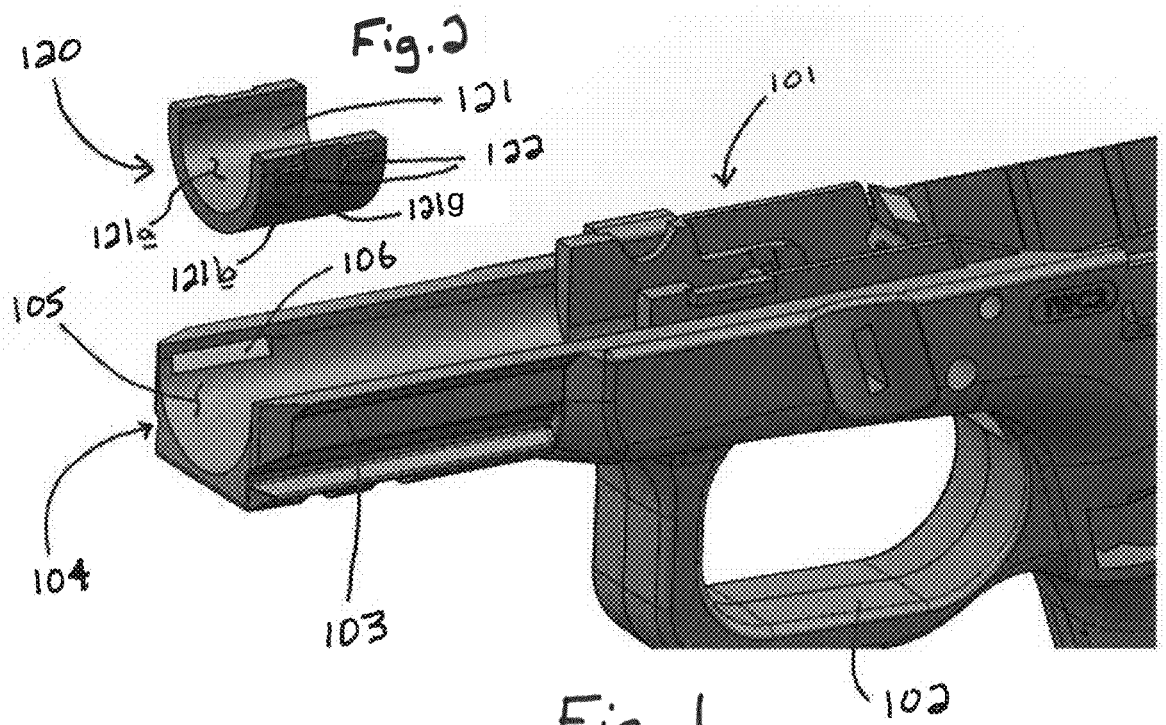
FIG. 1 is a side perspective elevation view of an example of one embodiment of this frame adapter system invention.
Figure 3:
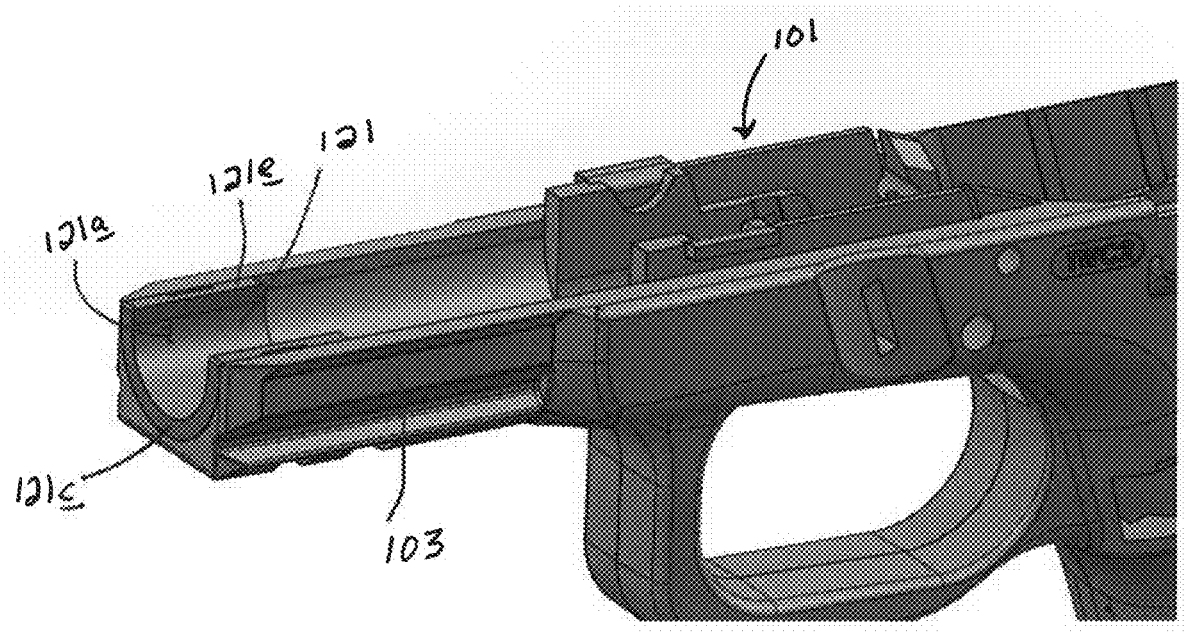
FIG. 3 is a perspective elevation view of the embodiment of the frame adapter illustrated in FIG. 1 with the embodiment of the conversion adapter illustrated in FIG. 2 installed therein.
Figure 4:
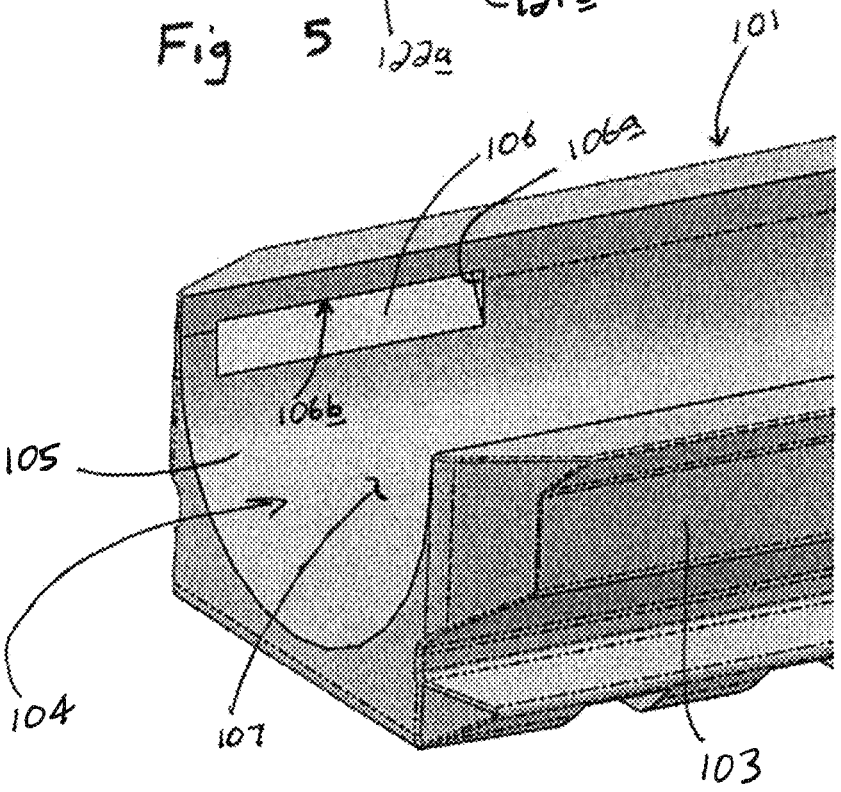
FIG. 4 is a perspective elevation and closeup view of the front portion of the handgun illustrated in FIG. 1.

FIG. 1 is a side perspective elevation view of an example of one embodiment of this frame adapter system invention, illustrating handgun frame 101 with front portion 103 of handgun frame 101, trigger guard 102, front opening 104, internal surface 105 (which is shown arcuate in nature), and notch 106 (shown more fully in FIG. 4). The notch 106 is configured to receive a conversion adapter 120 (illustrated in FIGS. 2, 3 & 5) with protrusions (such as items 122 in FIG. 5) on the outer surface thereof.

When the conversion adapter 120 is inserted into the front portion 103 of the frame, the protrusions 122 on the outer surface 121*b* of the conversion adapter 120 insert into the notches 106 (preferably on both or opposing sides of the frame 101) to secure the conversion adapter 120 into the front portion of the frame 101 (as shown assembled in FIG. 3).

Figure 5:
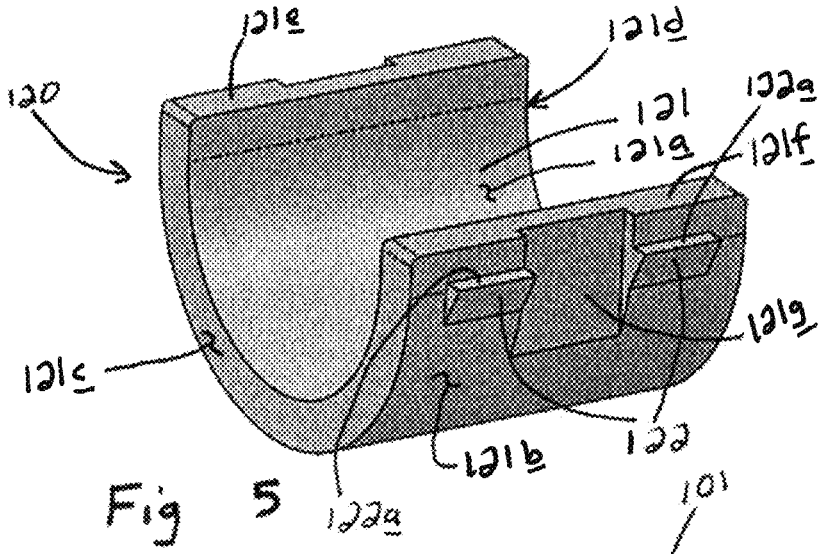
FIG. 5 is a perspective elevation and closeup view of the conversion adapter illustrated in FIG. 2.

A tight fit of the conversion adapter 120 in the frame 101 is preferable and this can be accomplished through tight tolerances and through designing and sizing the internal surface 105 of the frame 101 relative to the design and sizing of the external surface 121*b* of the conversion adapter 120 to have some flexibility or resilience, to achieve a tight fit or to enable the conversion adapter 120 to be snapped into position in a locked fit with the protrusions (items 122 in FIGS. 2 & 5 for example) in the frame 101. FIG. 1 and FIG. 5 further illustrate removal slot 121*h* and 121*g* in the adapter body 121, which provides an indentation or space to allow easier mechanical removal of the conversion adapter 120 from the handgun frame.

FIG. 2 is a side perspective elevation view of an example of one embodiment of a conversion adapter 120 which may be utilized in embodiments of this frame adapter system invention. FIG. 2 illustrates conversion adapter body 121, with interior surface 121*a*, exterior surface 121*b*, protrusions 122 which are configured to be securely received within notches (item 106 in FIGS. 1 & 4).

FIG. 3 is a perspective elevation view of the embodiment of the frame conversion adapter illustrated in FIG. 1 with the embodiment of the conversion adapter illustrated in FIG. 2 installed or inserted in the front portion 103 of the frame 101 of the handgun. FIG. 3 illustrates the conversion adapter body 121, inner surface 121*a*, top surface 121*e* and front surface 121*c*.

In an additional and alternative embodiment, the conversion adapter as shown in FIG. 3 may, instead of using the notch and protrusion configuration described, be secured through adhesives, glues or welding (through the use of a hot knife, vibration or other means). Although a permanent adaptation may not be preferred in some applications or embodiments, the conversion adapter may be attached to the handgun frame in this way.

FIG. 4 is a perspective elevation and closeup view of the front portion 103 of the handgun frame 101 shown in FIG. 1, illustrating the inner surface 107 of the front portion 103 of the handgun frame, front opening 104, front body portion and inner surface 107 of the frame. FIG. 4 further illustrates one example of an embodiment of a notch 106 that may be formed or disposed on the inside surface 107 of the body 105 of the front portion 103 of the frame, including an upper inner surface 106*b* of notch 106 (against which the top surface 122*a* of protrusion 122 may abut) to retain the conversion adapter 120 in the frame—as shown in FIGS. 4 & 5.

FIG. 5 is a perspective elevation and closeup view of the conversion adapter body 121 of the conversion adapter 120 illustrated in FIG. 2, including its front surface 121*c*, inner surface 121*a*, outer surface 121*b*, top surfaces 121*e* and 121*f* and rear surface 121*d*, protrusions 122 (with top surfaces 122*a*) which are configured to be securely received within notch(es) shown in other figures. It should be noted that, while not shown in FIG. 5, the opposing outer surface of the conversion adapter 120 is the same as this near outer surface shown, including with protrusions 122.

Figure 6:
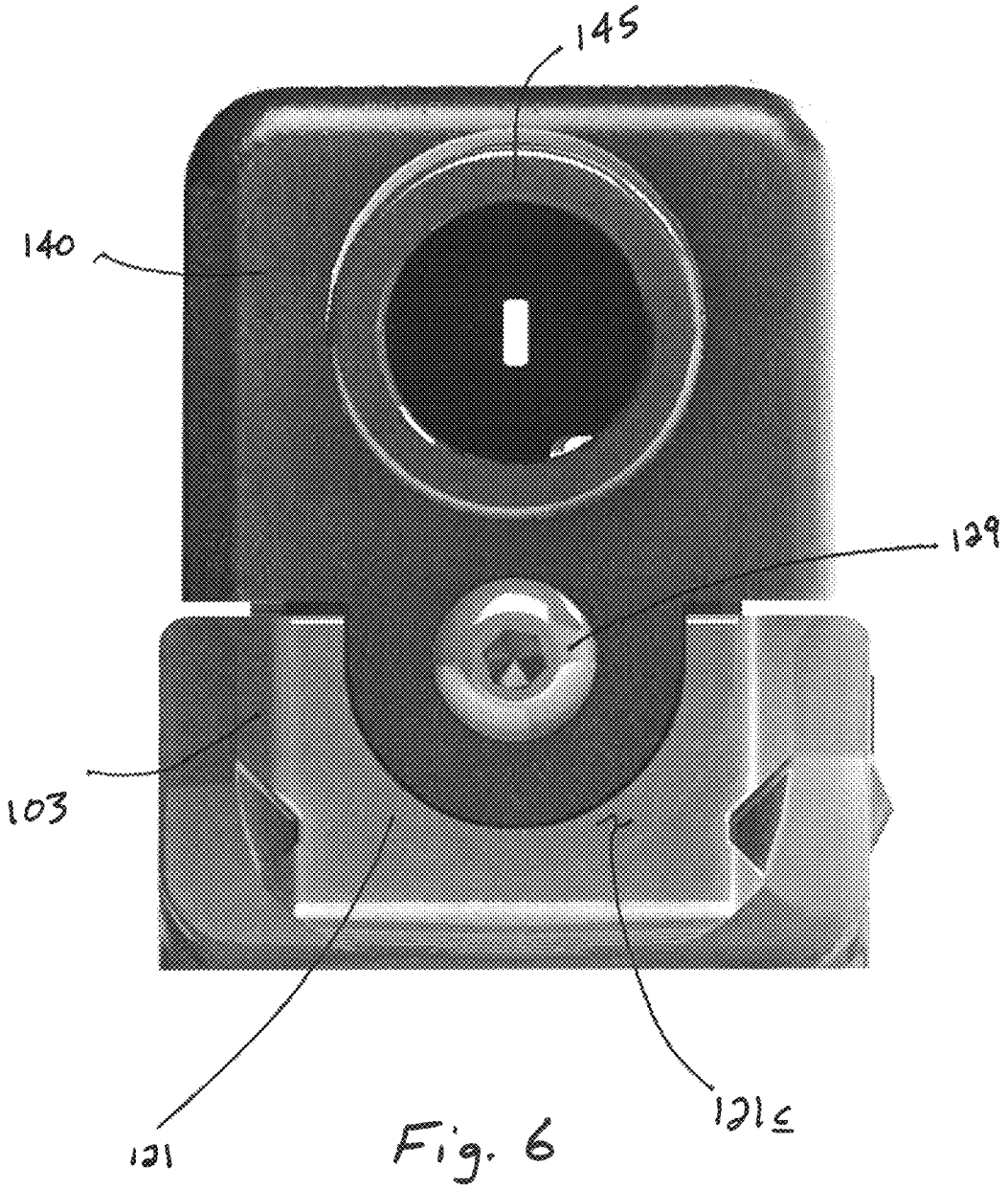
FIG. 6 is a front elevation view of the front of the slide (including the barrel), the front portion of the frame, and showing the conversion adapter.

FIG. 6 is a front elevation view of the front of the slide (including the barrel 145), the front portion 103 of the frame, the slide 140 and showing the conversion adapter 121 (including the front surface 121*c* of the conversion adapter) between the slide 140 and the front portion 103 of the frame. FIG. 6 further illustrates guide rod screw 129 (which may also be referred to as a recoil spring retainer or a slide spring fastener), which contributes to the securement or attachment of the spring (in this example a single stage spring configuration).

For example, the slide 140 in FIG. 6 may be the second predetermined slide and be a Glock® Gen 1, 2 or 3 handgun slide being placed on a Gen 4 or Gen 5 compatible frame (either of which can be the first predetermined slide) with the use of the conversion adapter and conversion system described herein.

Figure 7:
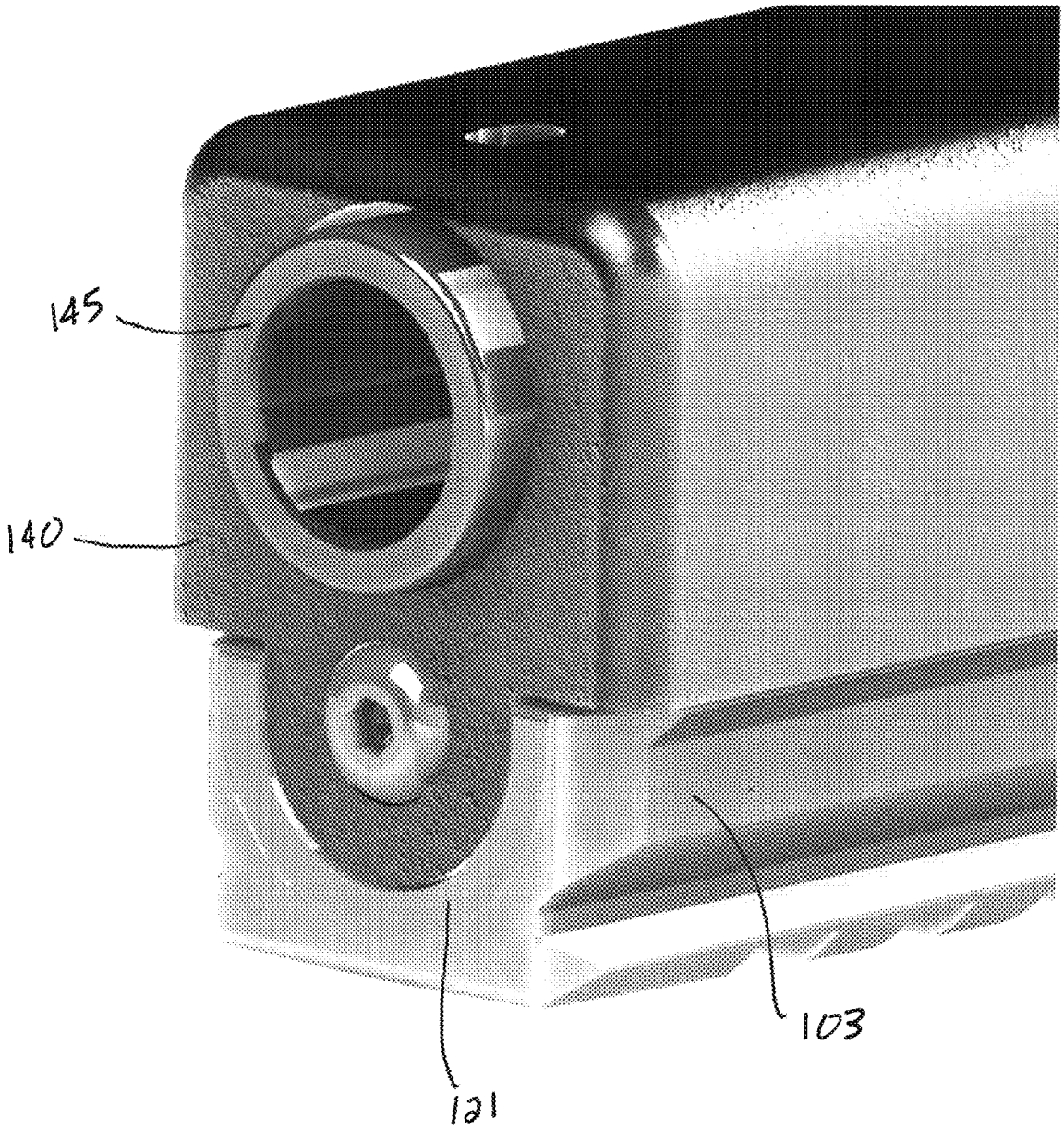
FIG. 7 is a front elevation perspective view of the front of the slide (including the barrel), the front portion of the frame, and showing the conversion adapter.

FIG. 7 is a front elevation perspective view of the front of the slide 140 (including the barrel 145), the front portion 103 of the frame, and showing the conversion adapter 121 between the slide 140 and the front portion 103 of the frame. It should also be noted from viewing FIGS. 6 & 7 with the conversion adapter 121 installed between the two components, that it may also function as a dust cover or dust shield, depending on how tight the fit is designed to be—especially when compared to FIGS. 9, 10 & 11 where no conversion adapter is shown between the front portion 103 of the frame and the slide 140.

Figure 8:
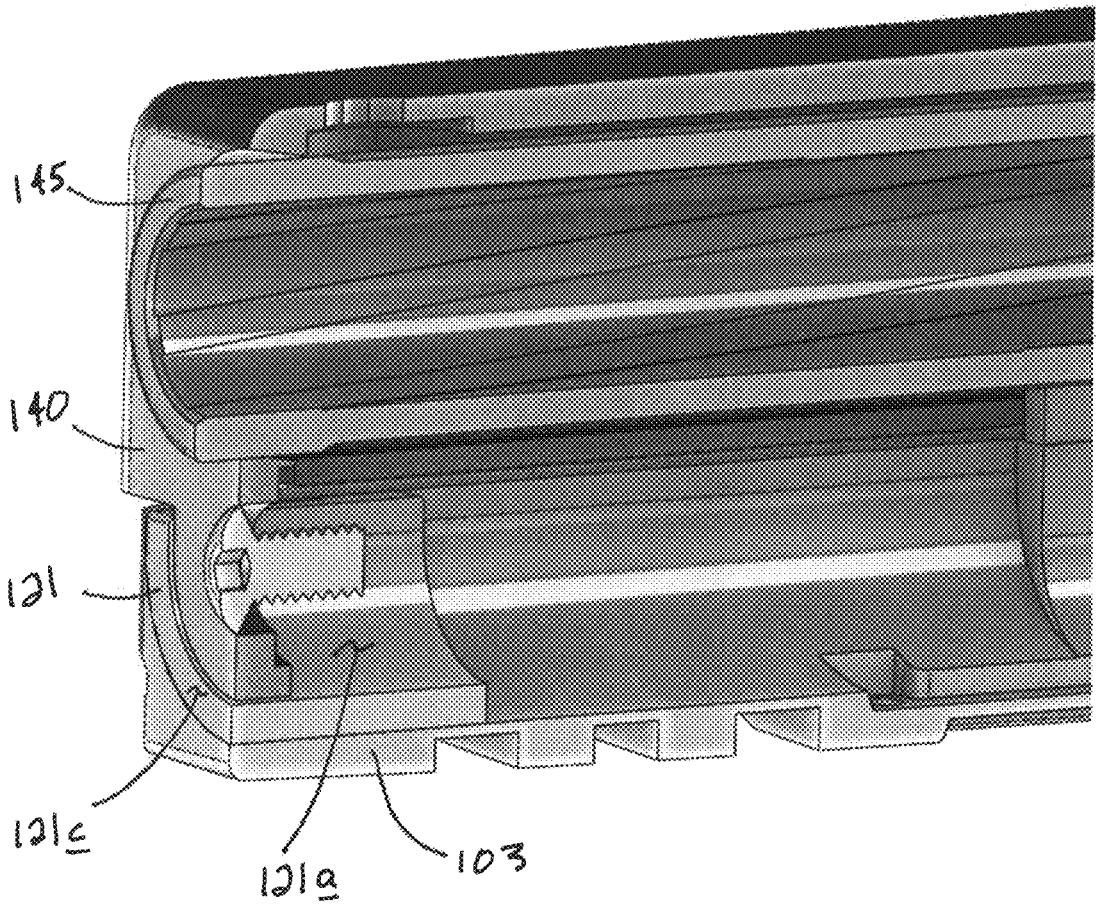
FIG. 8 is a front elevation perspective cutaway view of the front of the slide (including the barrel), the front portion of the frame, and showing the conversion adapter.

FIG. 8 is a front elevation perspective cutaway view of the front of the slide 140 (including the barrel 145), the front portion 103 of the frame, the conversion adapter 121 (including the front surface 121*c* and the inner surface 121*a*).

Figure 9:
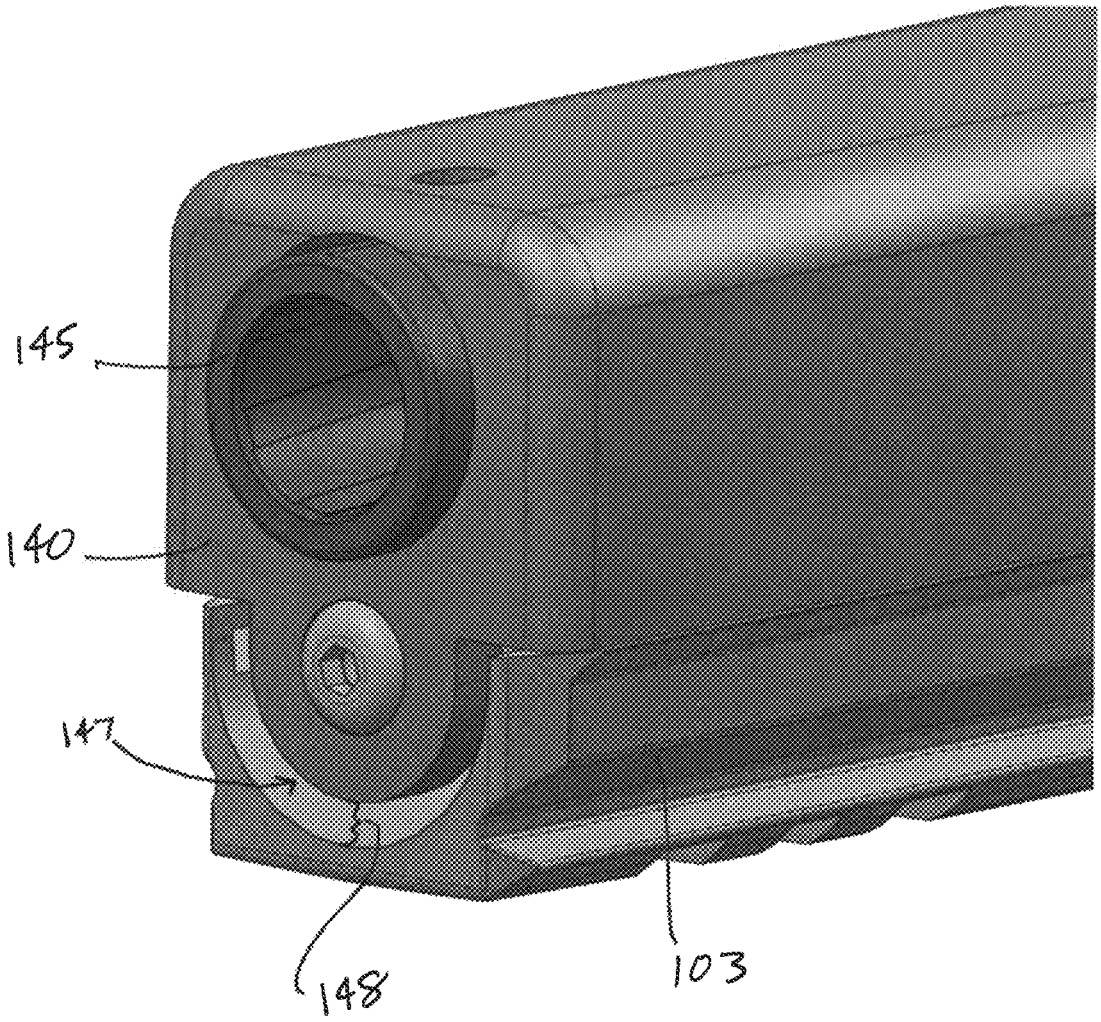

FIG. 9 is a front elevation perspective view of the front of the slide 140 (including the barrel 145), the front portion 103 of the frame, and showing the aperture or gap 147 (at a gap height as item 148) of the combination of the slide 140 and front portion 103 of the frame without the conversion adapter there-between.

Figure 10:
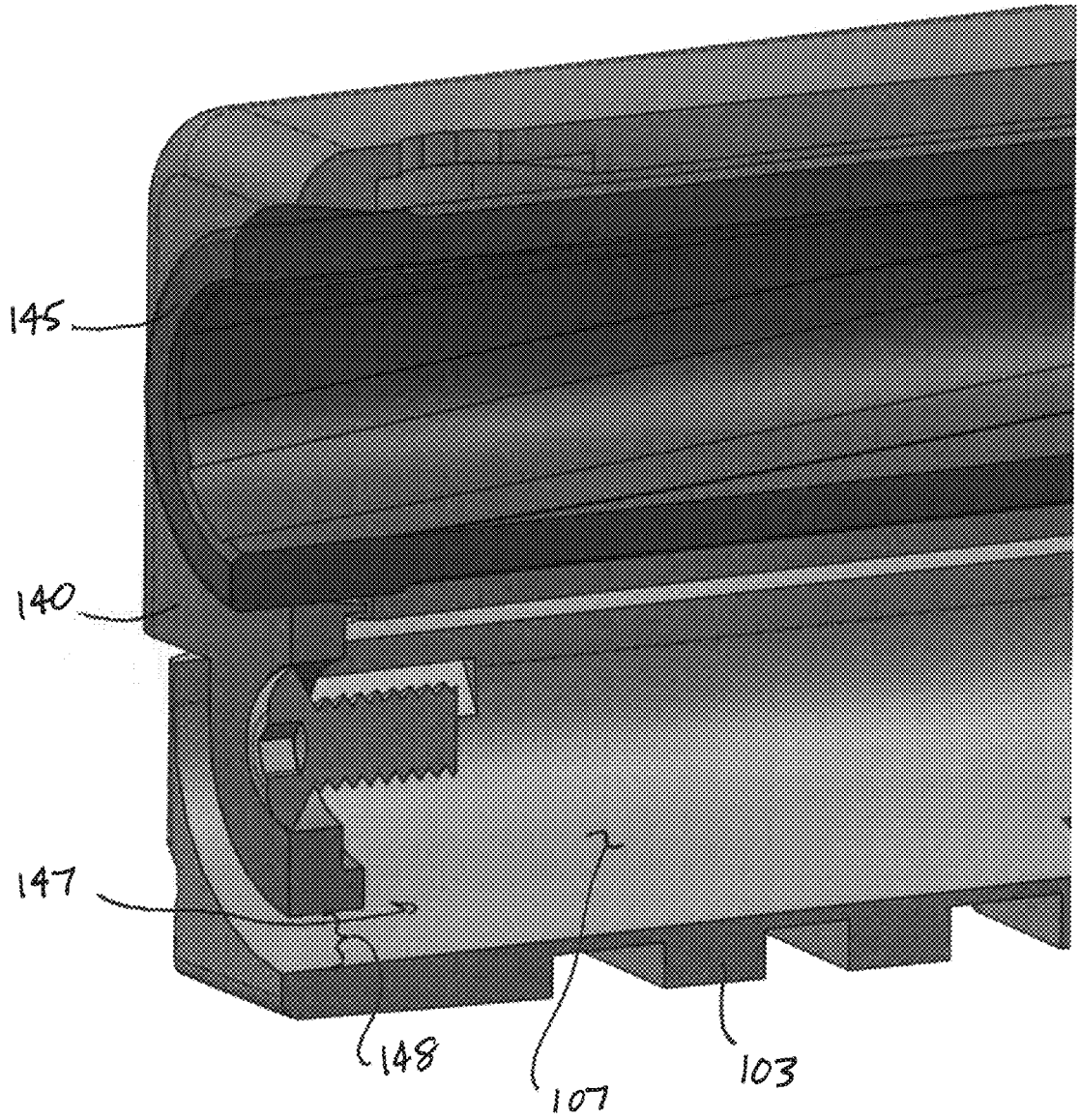

FIG. 10 is a front elevation perspective cutaway view of the front of the slide 140 (including the barrel 145), the front portion 103 of the frame (including inner surface 107 of the frame), and showing the aperture or gap 147 (at a gap height as item 148) of the combination of the slide 140 and front portion 103 of the frame without the conversion adapter there-between.

Figure 11:
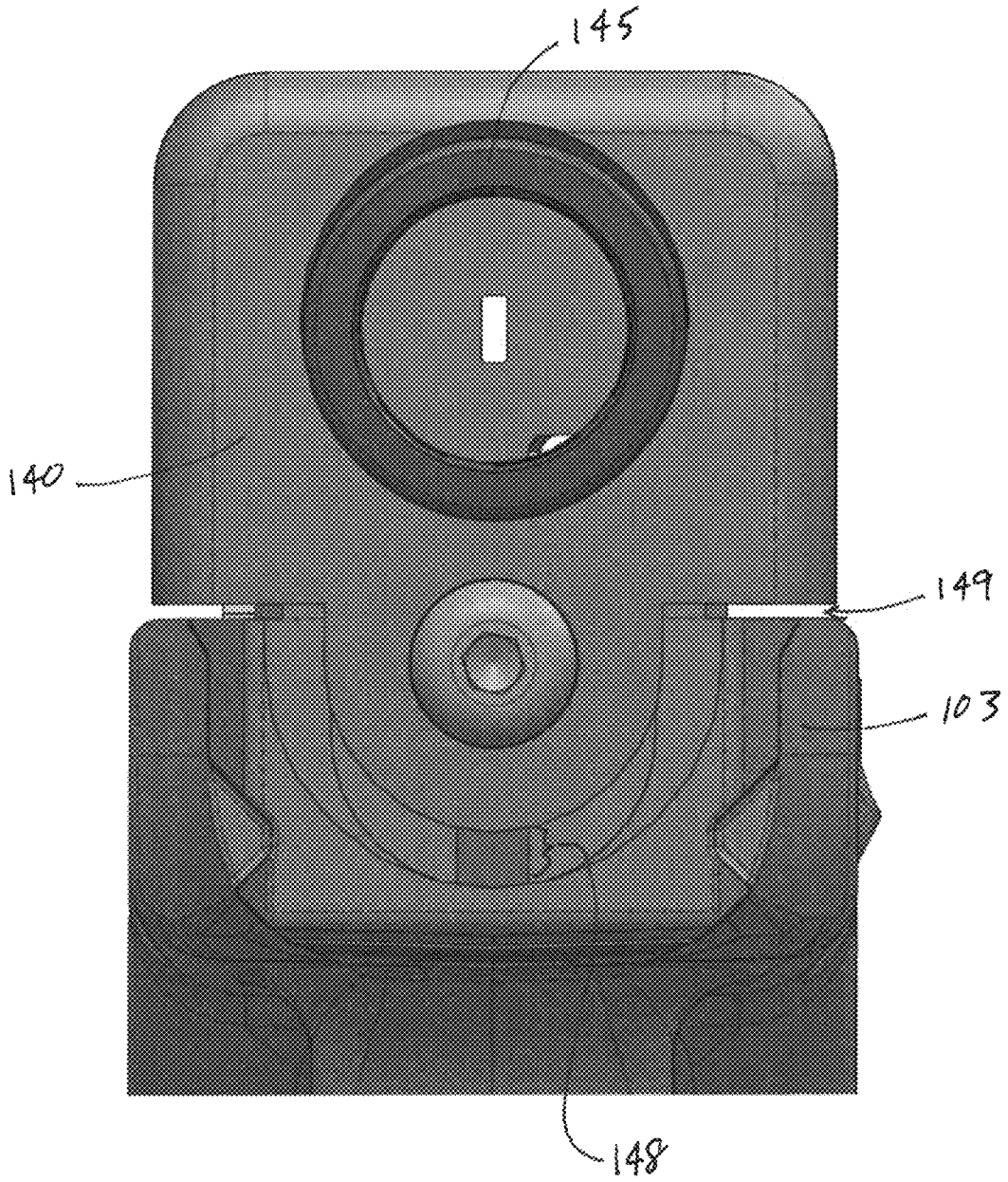

FIG. 11 is a front elevation view of the front of the slide 140 (including the barrel 145), the front portion 103 of the frame, and showing the combination without the conversion adapter and with a gap there-between (with the gap height shown as item 148).

Figure 12:
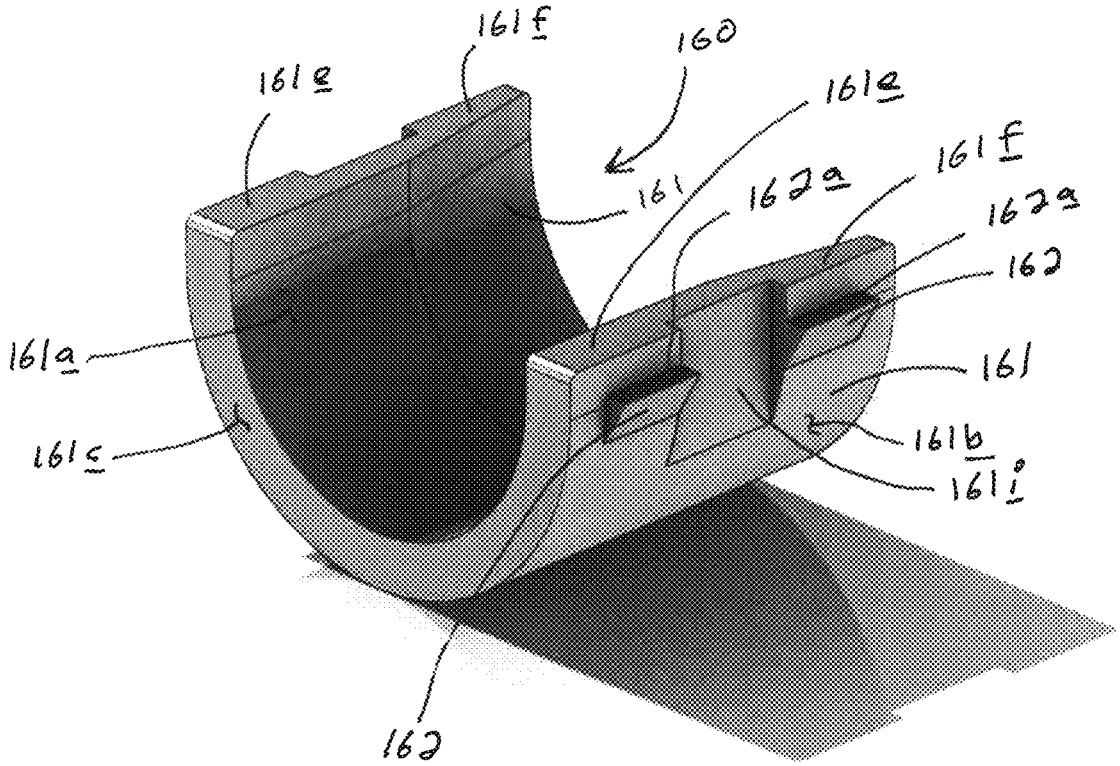
FIG. 12 is a front perspective view of one embodiment of a conversion adapter that may be used in practicing this invention.

FIG. 12 is a front perspective view of one embodiment of a conversion adapter 160 that may be used in practicing this invention, illustrating the conversion adapter body 161 of the conversion adapter 160, including its front surface 161*c*, inner surface 161*a*, outer surface 161*b*, front portion top surfaces 161*e* and rear portion top surfaces 161*f*, protrusions 162 (with top surfaces 162*a*) which are configured to be securely received within notch(es) 106 shown in other figures. It should be noted that, while not shown in FIG. 12, the opposing outer surface of the conversion adapter 160 is the same as this near outer surface shown, including with protrusions 162.

FIG. 12 further illustrates removal slot 161*i*. The removal slots 161*i* in the outer surface 161*b* of the adapter body 161 provide space between the outer surface 161*b* of the adapter body 161 and the inner surface of the frame (such as the installed adapter 232 with removal slot 237 illustrated in FIG. 19). It should be noted that while the removal slot 237 is shown located in the middle of the sides of the U-shape, the removal slots 237 may be located anywhere else with no one particular location being required to practice embodiments of this invention.

Figure 13:
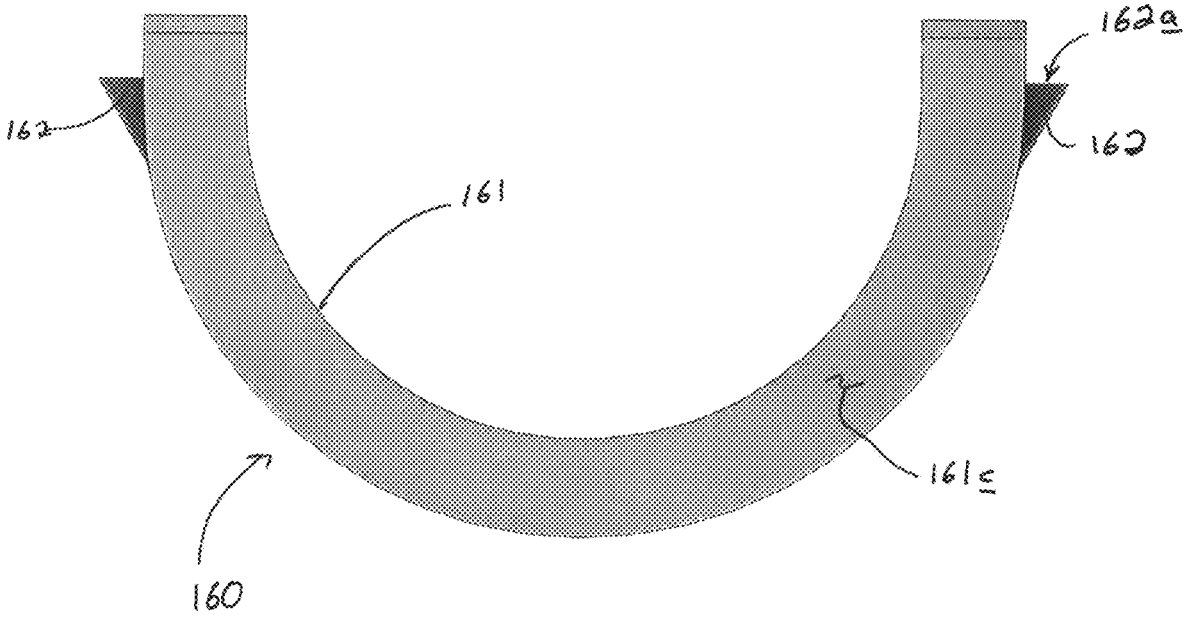
FIG. 13 is a front-end view of the embodiment of the conversion adapter shown in FIG. 12.

FIG. 13 is a front-end view of the embodiment of the conversion adapter 160 shown in FIG. 12, illustrating the conversion adapter body 161 of the conversion adapter 160, including its front surface 161*c*, protrusions 162 (with top surfaces 162*a*) which are configured to be securely received within notch(es) in the inner surface of the frame, as shown in other figures.

Figure 14:
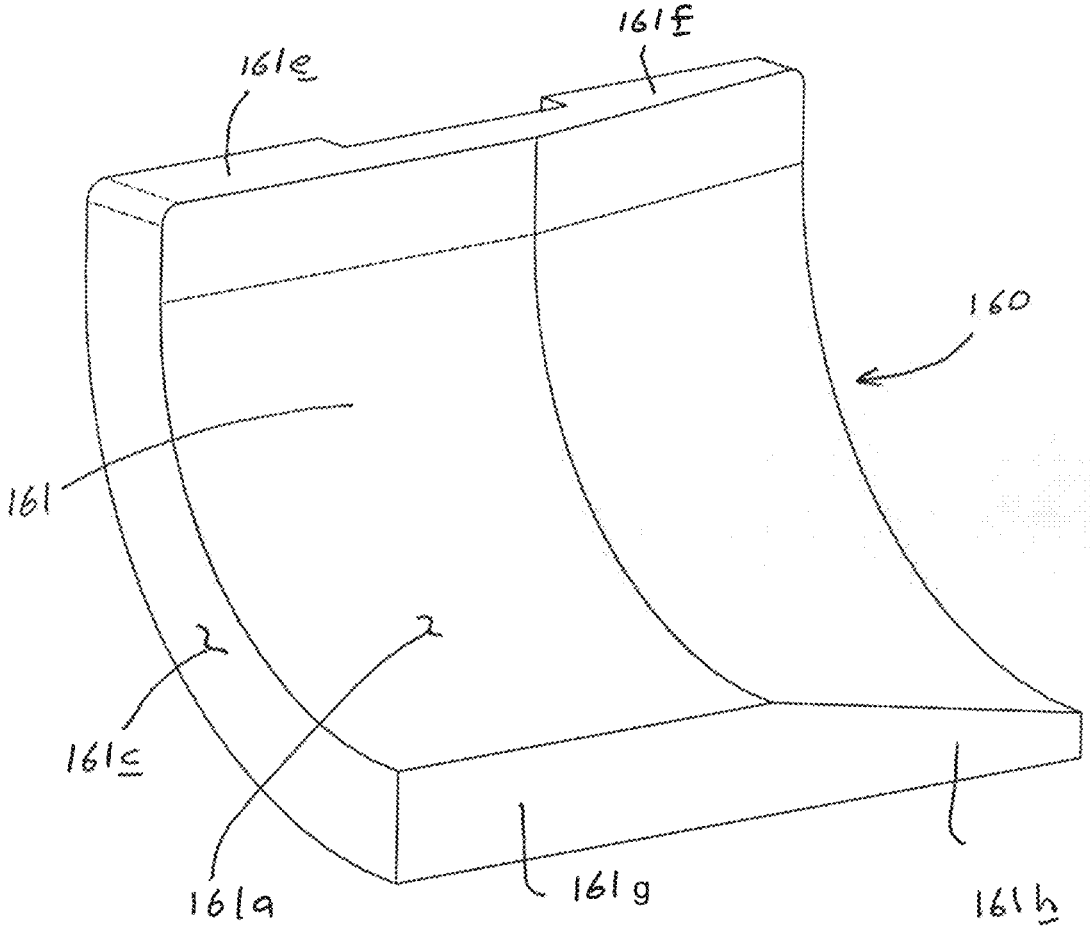
FIG. 14 is a front perspective cutaway view of the embodiment of the conversion adapter shown in FIG. 12, illustrating a taper on the rear-end of the adapter body.

FIG. 14 is a front perspective cutaway view of the embodiment of the conversion adapter shown in FIG. 12, showing a taper on the rear-end of the adapter body. FIG. 14 illustrates the conversion adapter body 161 of the conversion adapter 160, including its front surface 161*c*, inner surface 161*a*, front portion top surface 161*e*, rear portion top surface 161*f*, cross-section of front body portion 161*g*, cross-section of rear body portion 161*h* (tapered).

While the example of the embodiment shown in FIGS. 12-15 show a conversion adapter 160 with a smooth arcuate inner surface 161*a* and outer surface 161*b*, it should be noted that no particular surface contour is required to practice some embodiments of this invention on either the inner surface 161*a* or the outer surface 161*b* of the conversion adapter 160. In some embodiments it may be preferred to have a discontinuous outer surface for example to better facilitate the application of adhesives for example to attach the adapter to a particular handgun frame.

Figure 15:
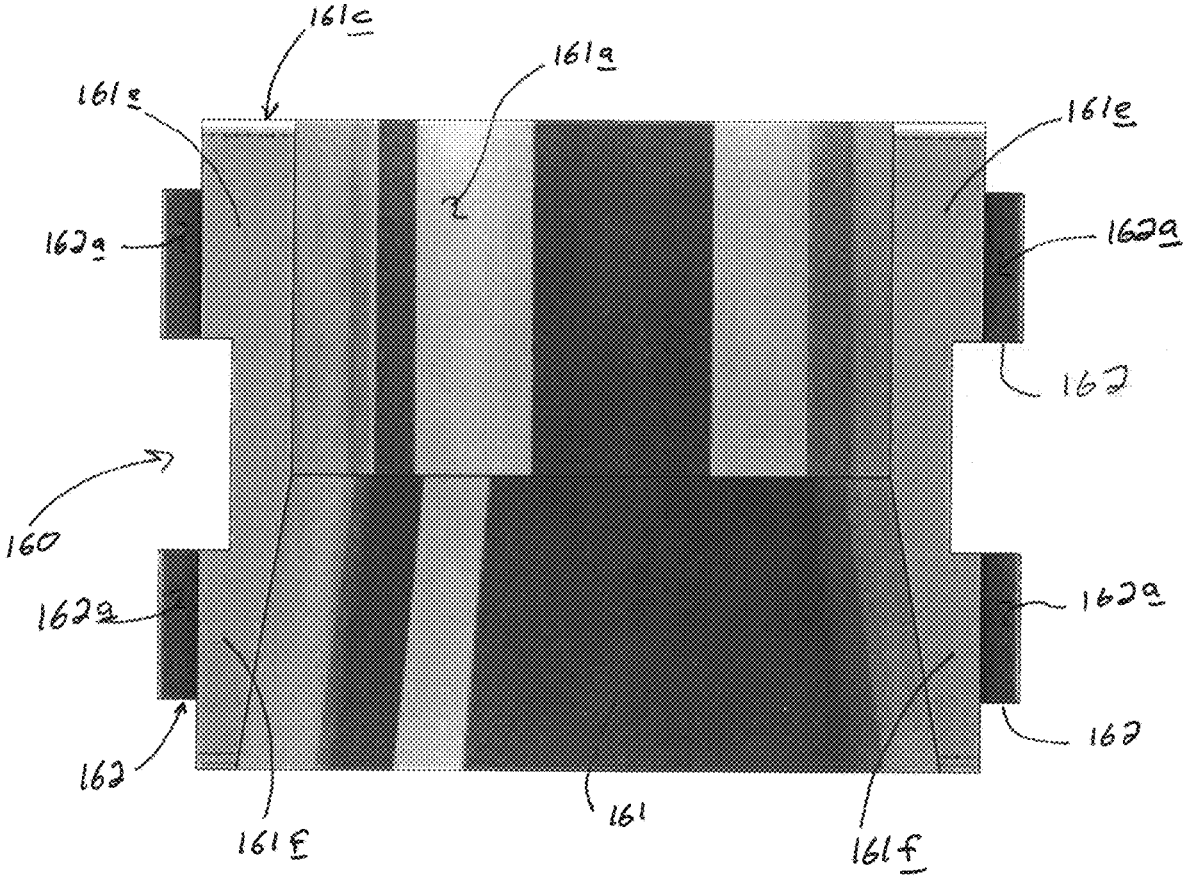
FIG. 15 is a top view of the embodiment of the conversion adapter shown in FIG. 12.

FIG. 15 is a top view of the embodiment of the conversion adapter shown in FIG. 12, illustrating the conversion adapter body 161 of the conversion adapter 160, including its front surface 161*c*, inner surface 161*a*, front portion top surfaces 161*e* and rear portion top surfaces 161*f*, and protrusions 162 (with top surfaces 162*a*).

Figure 16:
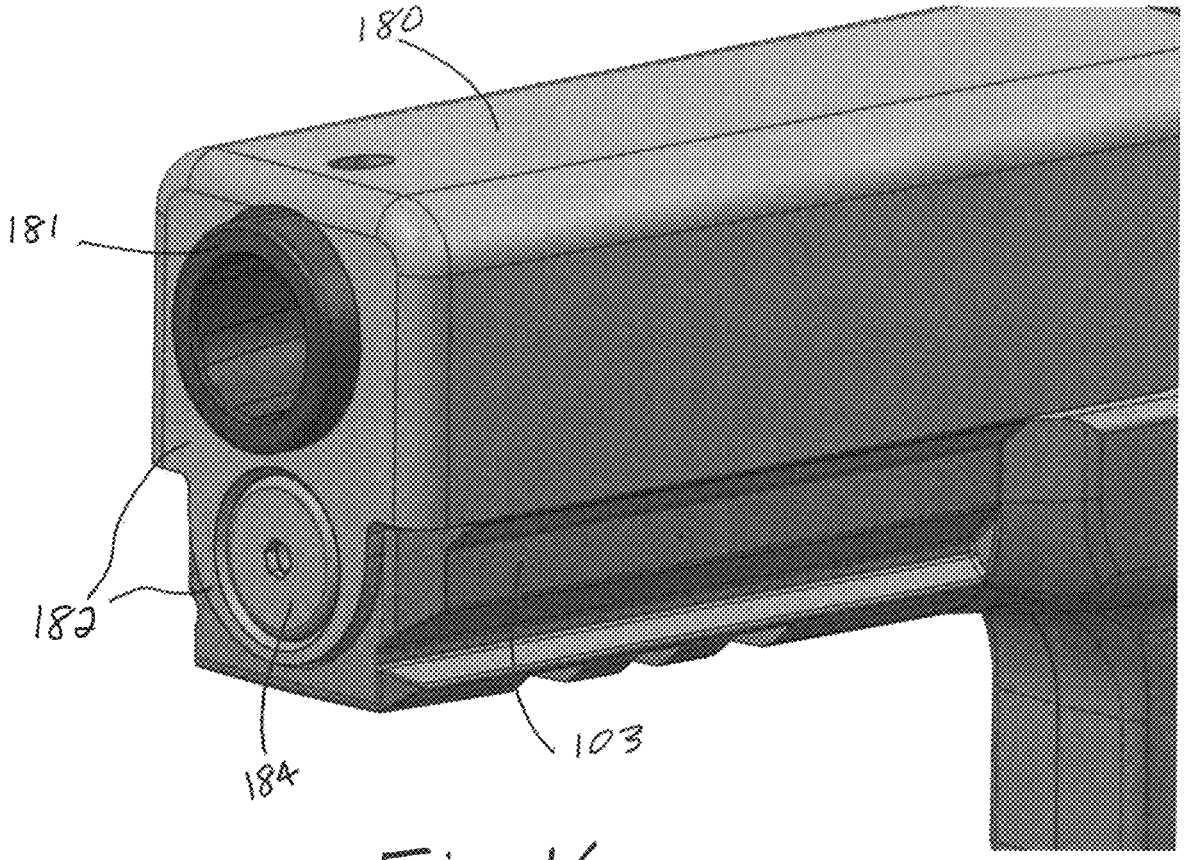
FIG. 16 is a front perspective view of a typical Glock® Gen 4 slide on a Gen 4 compatible frame.

FIG. 16 is a front perspective view of a typical Glock® Gen 4 slide on a Gen 4 compatible frame, illustrating the front portion 103 of a Gen 4 compatible frame, with a Glock® Gen 4 slide 180 mounted thereon. From its characteristics relative to this invention and the purpose of this invention, the Glock® Gen 5 is the same or similar to the Gen 4. A comparison of the front surface 182 of the Gen 4 slide with the front of the prior generation Glock® slide shown in FIGS. 6 & 7 for example, illustrates why the Glock® Gen 1, 2 and 3 slides are not designed for and are not compatible with the Gen 4 frame (which is instead designed to receive the Gen 4 slide as shown in FIG. 16). FIG. 16 further illustrates guide rod screw 184, which contributes to the securement or attachment of the spring (in this example a dual stage spring configuration). While FIG. 16 is an image of a Gen 4, the same would apply to a Gen 5 frame.

Figure 17:
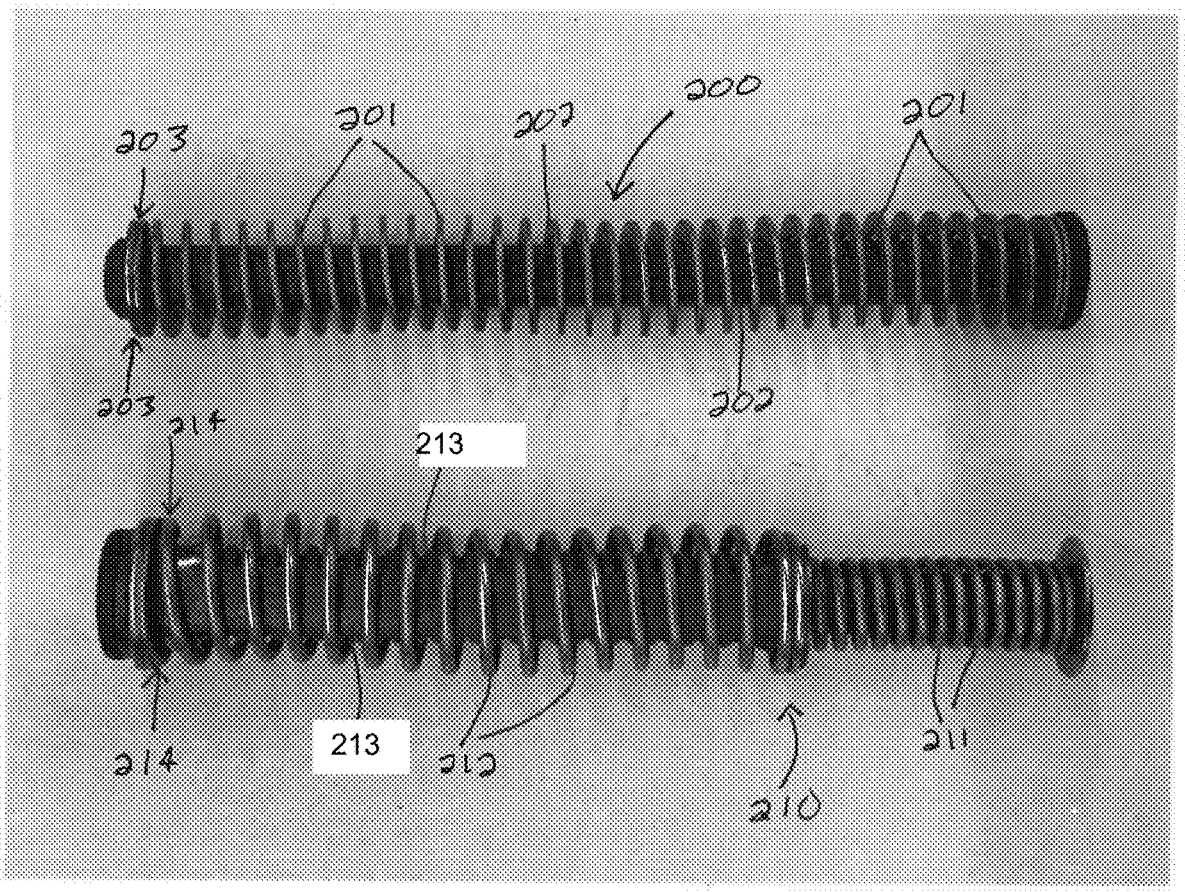
FIG. 17 is a top view of a single stage handgun spring (on top part of image) and a dual stage handgun spring (lower part of image)

FIG. 17 is a top view of a single stage handgun spring 200 (on top part of image) and a dual stage handgun spring 210 (lower part of image). FIG. 17 illustrates the differences between the size and nature of the single stage spring 200 versus the dual stage spring 210, including the narrower width or diameter 203 of the single stage spring 200 versus the width or diameter 214 of the dual stage spring 210. FIG. 17 shows the spring 201 around the axis 202 on the single stage spring, and the first spring 211 and the second spring 212 around spring axis 213 on the dual stage spring 210.

It should be noted that even though the Glock® handguns are referred to throughout this specification, that is because the Glock® Gens 1, 2 & 3 have a single stage spring and the Glock® Gens 4 & 5 have the larger diameter dual stage spring configuration. This invention has application beyond Glock® to all handguns wherein it is desired to use a single stage spring-based slide combined with an otherwise dual stage spring-based frame interchangeable with the dual stage spring-based slide.

It should be further noted that embodiments of this invention include modifying (cutting, drilling, etc.) the interior or inner surface of a frame (including an OEM frame) by imparting a notch therein which would then correspond with protrusions on the outer surface of the conversion adapter. Embodiments of this invention further include providing a handgun frame with the notches already cut or molded therein, to receive the adapter. It should still further be noted that embodiments of this invention may include an adapter body without the protrusions, placed in the front portion of the handgun frame to adapt that frame to accept a dissimilar slide (such as for example—accepting or receiving a single stage spring slide for mounting on a handgun frame designed to receive a larger diameter dual stage spring slide).

When the term "notch" is used herein, it is not limited to just a notch, but instead is further defined as an aperture or indentation configured to operably receive and removably retain the protrusion on the exterior of the conversion adapter. Furthermore, when the term "protrusion" is used herein, it is not limited but instead includes any protrusion, projection, protrusion, barb, tab, jut or other extending component configured to be operably positioned within the notch to secure the conversion adapter within the interior of the frame.

It should further be noted that instead of securing the conversion adapter to the inner surface of the handgun frame through a notch and protrusion, it can also be secured to the handgun frame through use of a fastener (as described elsewhere herein), a dovetail joint or connection, rabbet joints or connections, or more permanently affixing it with an adhesive or a heated or welded type of joint with the thermoplastic nature of the frame.

Embodiments of this conversion system in a broader sense involve: providing a handgun frame that has been modified to securely receive a conversion adapter, or modifying said handgun frame to securely receive said conversion adapter. While embodiments described above are directed toward modifying the prior art handgun frame through the placement of a notch, indent or aperture in the interior surface thereof—which correspond to protrusions on the outer surface of the adapter, embodiments of this invention are not limited to that specific method.

Alternative embodiments of this invention may involve providing a handgun frame with for example an aperture through the bottom of the interior surface of the front portion of the handgun frame so that a screw or other fastener may be placed there-through and for example screwed into an internally threaded screw aperture in the outer surface of the conversion adapter. In this alternative embodiment for example, the conversion adapter may then be placed on the interior surface of the handgun frame with the screw aperture in the outer surface of the conversion adapter aligned with the aperture in the handgun frame, and then rotating a screw through both apertures to thereby secure the conversion adapter to the handgun frame. It should be noted that the fastener apertures may be drilled or tapped from through the handgun frame and then into the conversion adapter, or drilled or tapped through the conversion adapter and then into the handgun frame, all within the scope of some embodiments of this invention.

Figure 18:
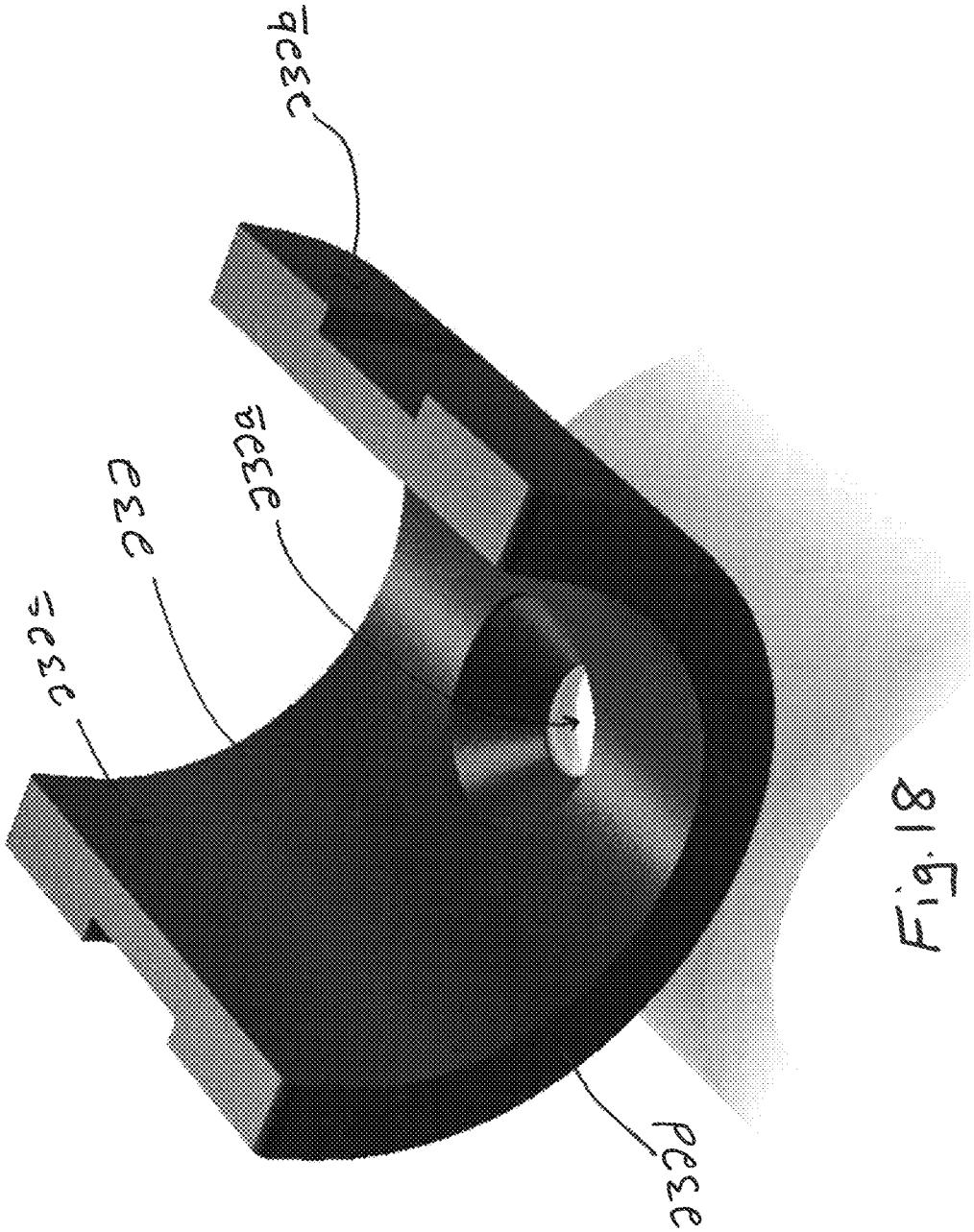
FIG. 18 is a front elevation perspective view of an example of an alternative embodiment of a conversion adapter that may be used in embodiments of this invention, one in which a screw fastener is used to attach the conversion adapter to the handgun frame.

FIG. 18 is a front elevation perspective view of an example of an alternative embodiment of a conversion adapter 232 that may be used in embodiments of this invention, one in which a screw fastener is used to attach the conversion adapter 232 to an inner surface of a handgun frame. FIG. 18 illustrates conversion adapter 232 with inner surface 232*c*, outer surface 232*b*, front surface 232*d* and fastener aperture 232*a* through the conversion adapter 232.

Figure 19:
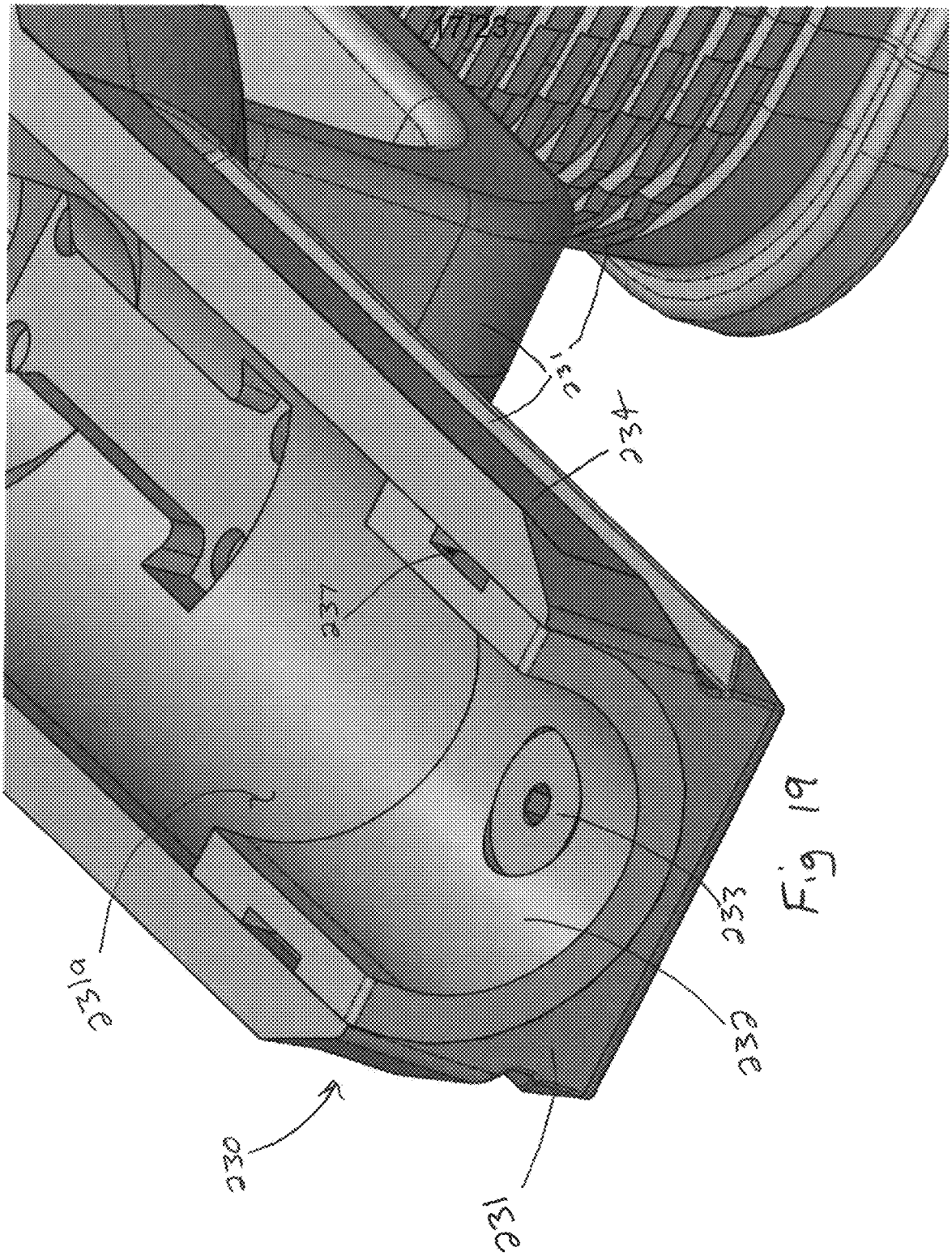
FIG. 19 is a front elevation perspective view of the alternative embodiment of a conversion adapter illustrated in FIG. 18, and is shown inserted and secured in the front portion of a handgun frame via a screw fastener.
Figure 20:
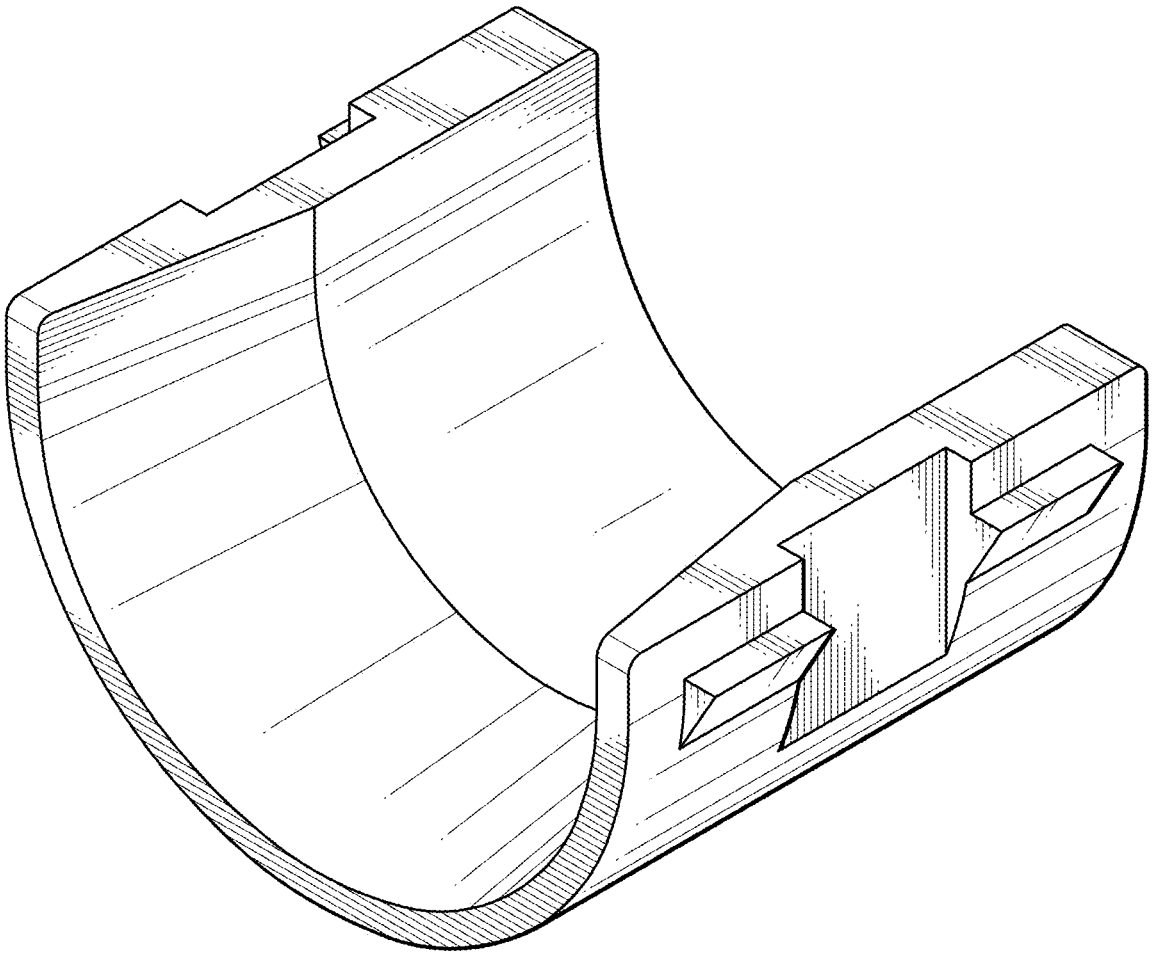
FIG. 20 is a front perspective view of one ornamental embodiment of a handgun frame conversion adapter.
Figure 21:
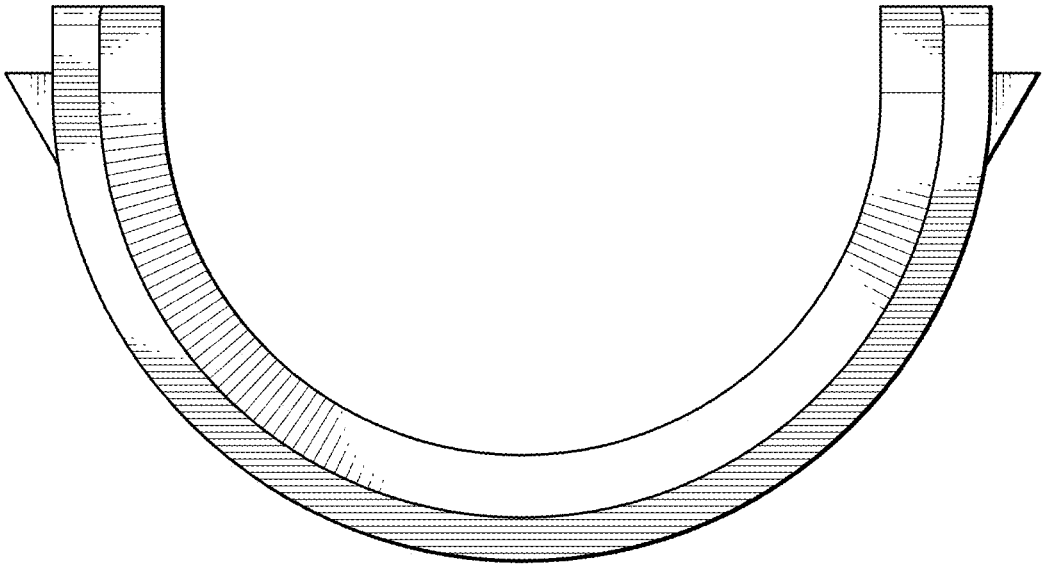
FIG. 21 is a rear end view of the one ornamental embodiment of the handgun frame conversion adapter referenced in FIG. 20.
Figure 22:
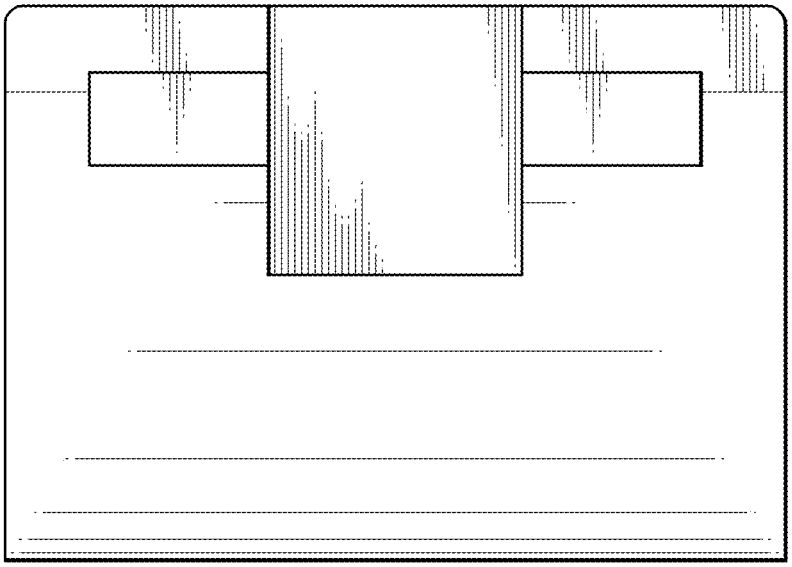
FIG. 22 is a left side view, and also a right side view, of the one ornamental embodiment of the handgun frame conversion adapter referenced in FIG. 20.
Figure 23:
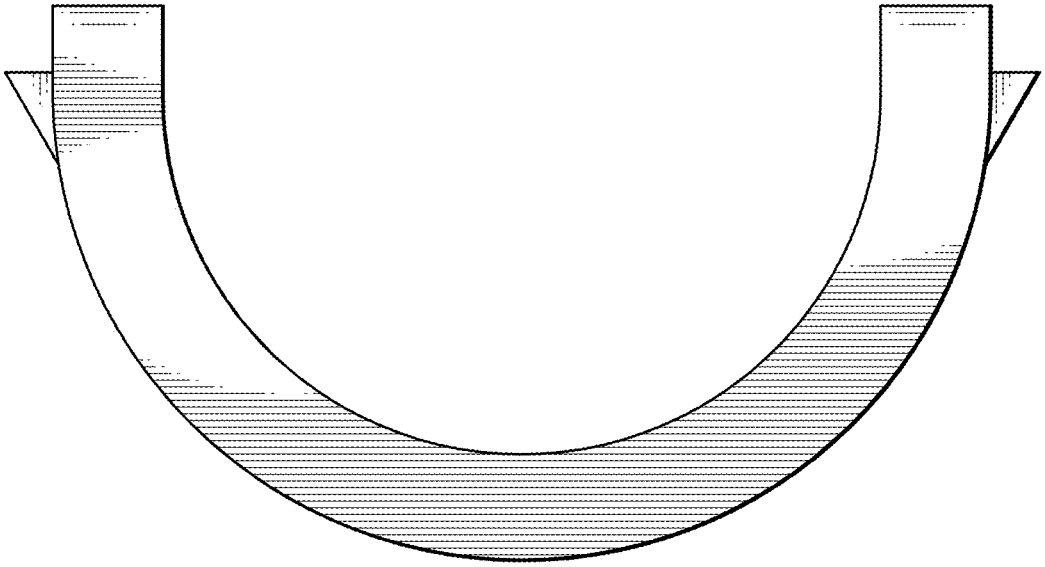
FIG. 23 is a front end view of the one ornamental embodiment of the handgun frame conversion adapter referenced in FIG. 20.
Figure 24:
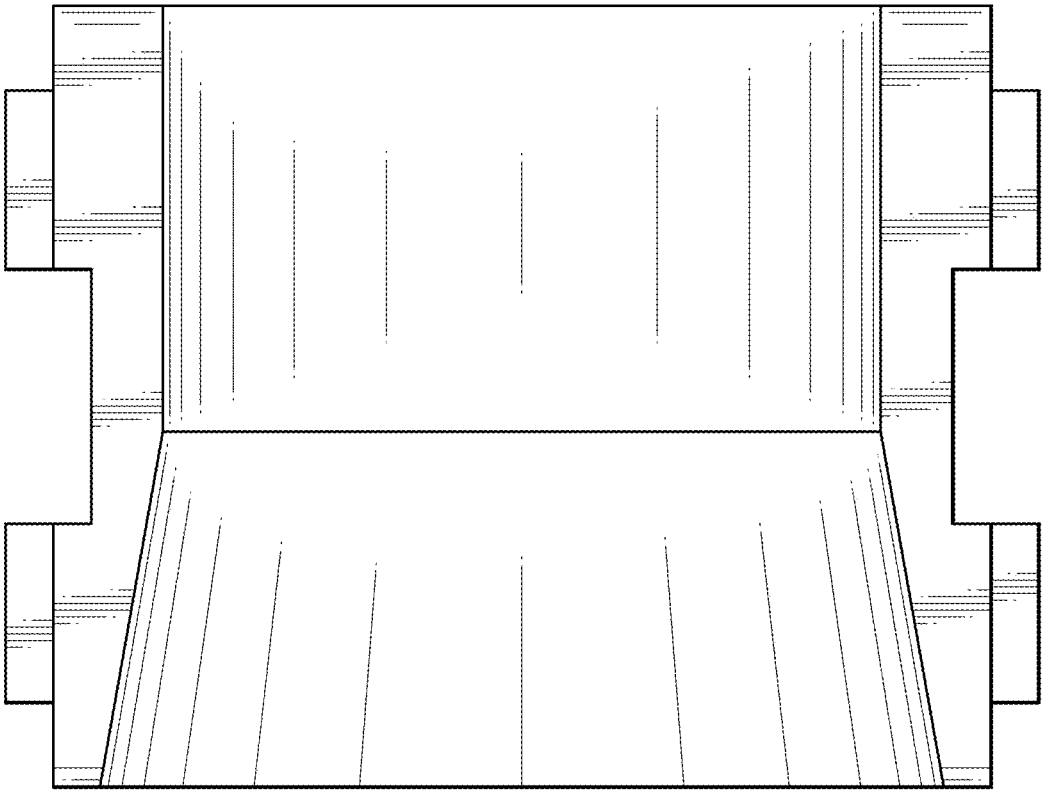
FIG. 24 is a top view of the one ornamental embodiment of the handgun frame conversion adapter referenced in FIG. 20.
Figure 25:
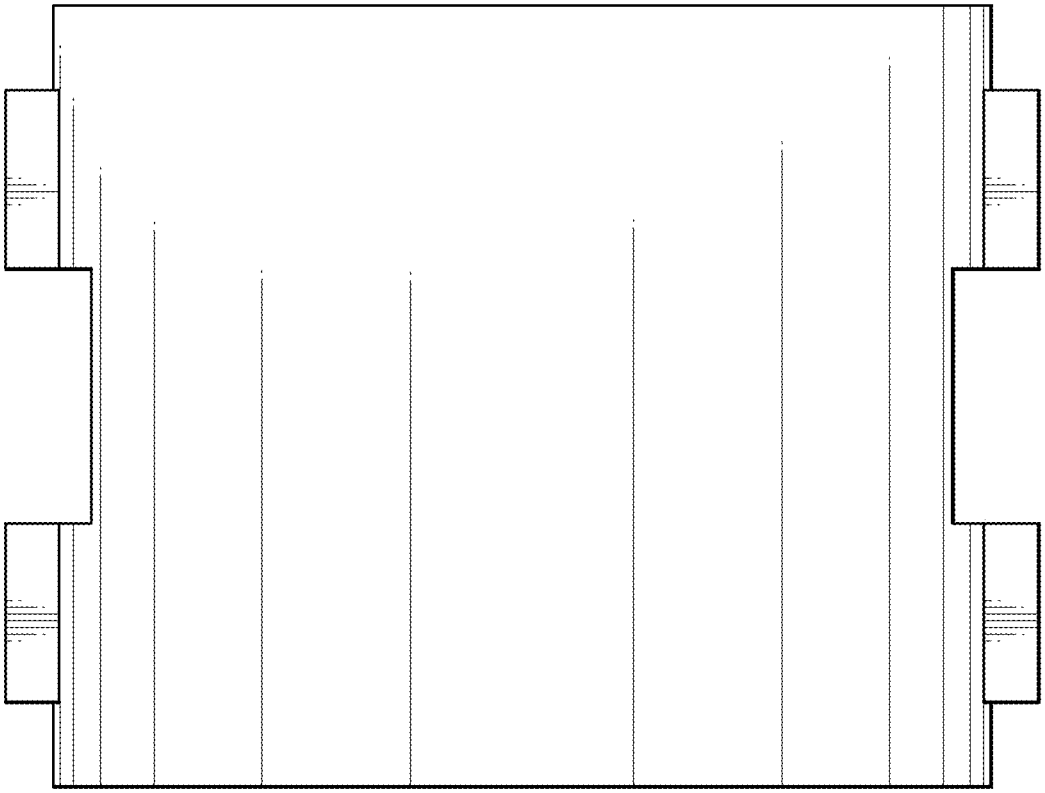
FIG. 25 is a bottom view of the one ornamental embodiment of the handgun frame conversion adapter referenced in FIG. 20.

FIG. 19 is a front elevation perspective view of the alternative embodiment of a conversion adapter 232 illustrated in FIG. 18, and is shown inserted and secured in the front portion 234 of a handgun frame via a screw fastener 233. FIG. 19 illustrates frame 231, front portion of handgun frame 234, inner surface 231*a* of frame 231 conversion adapter 232, screw fastener 233 inserted in fastener aperture 232*a* (shown in FIG. 18), and the threaded end of the screw fastener 233 would be screwed or securely inserted into a screw aperture in the handgun frame.

As will be appreciated by those of reasonable skill in the art, there are numerous embodiments to this invention, and variations of elements, components and combinations, which may be used, all within the scope of this invention.

One embodiment of this invention, for example, is a handgun frame adapter system wherein two or more dissimilar handgun slides may be operably mounted to one handgun frame, comprising: a handgun frame configured to operably receive a first predetermined handgun slide; a conversion adapter which when mounted within a front portion of the handgun frame, wherein the conversion adapter allows the handgun frame to operably receive a second predetermined handgun slide.

A further embodiment to that disclosed in the preceding paragraph is: further wherein the first predetermined handgun slide is a Glock® generation 4 or generation 5 slide and the second predetermined handgun slide is one or more of a Glock® generation 1, generation 2 and/or generation 3 handgun slide(s); and/or further comprising: a handgun frame which includes opposing notches defined in an inner surface of the frame, configured to receive and retain a conversion adapter comprised of: a U-shaped adapter body with an outer surface, an inner surface, a front end and a rear end, the inner surface and outer surfaces being generally arcuate, and with the outer surface including one or more protrusions thereon which are configured to insert into the notches in the inner surface of the front portion of the frame to operably attach the conversion adapter to the front portion of the frame.

A further embodiment to that disclosed in the preceding paragraph is further wherein the conversion adapter is configured such that a surface of the front-end fills most of a gap between the second predetermined slide and the front portion of the handgun frame; and in some further embodiments, the rear end of the conversion adapter is sloped downwardly to the inner surface of the frame.

In still further embodiments of the system, a method of utilizing one handgun frame to adaptably receive at least a first predetermined handgun slide and a second predetermined handgun slide dissimilar from the first predetermined handgun slide is provided and which is comprised of: providing a handgun frame configured to operably receive a first predetermined handgun slide; providing a conversion adapter which is operably mounted within a front portion of the handgun frame and mounting the conversion adapter within the front portion of the handgun frame; and operably mounting a second predetermined handgun slide on the handgun frame such that the conversion adapter fills a gap between the front portion of the handgun frame and the second predetermined handgun slide.

A further embodiment to that disclosed in the preceding paragraph is further wherein the first predetermined handgun slide is a Glock® generation 4 or generation 5 slide and the second predetermined handgun slide is one or more of a Glock® generation 1, generation 2 and/or generation 3 handgun slide(s).

In yet another embodiment of this invention, a method of utilizing one handgun frame to adaptably receive at least a first predetermined handgun slide and a second predetermined handgun slide dissimilar from the first predetermined handgun slide may be provided, comprised of: providing a handgun frame with an internal cavity with an internal surface configured to operably receive the first predetermined handgun slide; providing a conversion adapter with an internally threaded aperture in its outer surface which corresponds to a fastener aperture placed in a front portion of the handgun frame; placing the conversion adapter in the front portion of the handgun frame such that the fastener aperture in the outer surface of the conversion adapter is aligned with the fastener adapter in the front portion of the handgun frame; inserting a fastener through the fastener aperture in the frame and into the fastener aperture in the outer surface of the conversion adapter, thereby securing the conversion adapter to the front portion of the handgun frame; and wherein the handgun frame with the conversion adapter secured therein configures the handgun frame to receive the second predetermined slide.

Additional and further embodiments to that stated in the preceding paragraph may include such a method and further wherein: the fastener is a screw which is inserted by threading it through the fastener aperture in the handgun frame and threading it through the fastener aperture in the conversion adapter; and/or the first predetermined slide includes a single stage spring configuration and the second predetermined slide includes a dual stage spring configuration.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A handgun frame adapter system wherein two or more dissimilar handgun slides may be operably mounted to one handgun frame, the adapter system comprising:

a handgun frame configured to operably receive a first predetermined handgun slide, the handgun frame including opposing notches defined in an inner surface of the handgun frame and configured to receive and retain a conversion adapter; and a conversion adapter, which when mounted within a front portion of the handgun frame, allows the handgun frame to operably receive a second predetermined handgun slide, the conversion adapter being comprised of:

a U-shaped adapter body with an outer surface, an inner surface a front end and a rear end, the inner surface and outer surfaces being generally arcuate, and with the outer surface including one or more protrusions thereon which are configured to insert into the notches in the inner surface of the front portion of the frame to operably attach the conversion adapter to the front portion of the frame;

the adapter body further including a center aperture in the semi-circular cover portion and the adapter body being configured to mount at or near the front surface of the slide between the slide and frame such that the adapter body is a barrier to dust entering between the slide and the frame.

2. The handgun frame adapter system as recited in claim 1, and further wherein the first predetermined handgun slide is a dual stage spring slide and the second predetermined handgun slide is single stage spring slide.

3. The handgun frame adapter system as recited in claim 1, and further wherein the first predetermined handgun slide is a Glock® compatible generation 4 or generation 5 slide and the second predetermined handgun slide is one or more of a Glock® or Glock® compatible generation 1, generation 2 and/or generation 3 handgun slide(s).

4. The handgun frame adapter system as recited in claim 1, and further wherein the conversion adapter is mounted to the handgun frame as follows: the handgun frame includes opposing notches defined in an inner surface of the frame, configured to receive and retain the conversion adapter which is comprised of:

a U-shaped adapter body with an outer surface, an inner surface a front end and a rear end, the inner surface and outer surfaces being generally arcuate, and with the outer surface including one or more protrusions thereon which are configured to insert into the notches in the inner surface of the front portion of the frame to operably attach the conversion adapter to front portion of the frame.

5. The handgun frame adapter system as recited in claim 4, and further wherein the conversion adapter is configured such that a surface of the front-end fills most of a gap between the second predetermined slide and the front portion of the handgun frame.

6. The handgun frame adapter system as recited in claim 5, and further wherein the rear end of the conversion adapter is sloped downwardly to the inner surface of the frame.

7. The handgun frame adapter system as recited in claim 1, and further wherein the front portion of the handgun frame includes a fastener aperture which aligns with a fastener aperture in the conversion adapter such that a fastener may be inserted into both fastener apertures to secure the conversion adapter to the handgun frame.

8. The handgun frame adapter system as recited in claim 1, and further wherein the conversion adapter is mounted to the handgun frame through one or more of the following: adhesive between the inner surface of the handgun frame and the outer surface of the conversion adapter; a heat weld between the inner surface of the handgun frame and the outer surface of the conversion adapter; a dovetail joint between the inner surface of the handgun frame and the outer surface of the conversion adapter; and/or a rabbet joint between the inner surface of the handgun frame and the outer surface of the conversion adapter.

* * * * *